US011447919B2

(12) United States Patent
Neusch

(10) Patent No.: US 11,447,919 B2
(45) **Date of Patent: *Sep. 20, 2022**

(54) VEHICLE GATE ASSEMBLY

(71) Applicant: NEUSCH INNOVATIONS, LP, Marble Falls, TX (US)

(72) Inventor: William H. Neusch, Marble Falls, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/158,174

(22) Filed: Jan. 26, 2021

(65) Prior Publication Data

US 2021/0148071 A1 May 20, 2021

Related U.S. Application Data

(63) Continuation of application No. 16/011,860, filed on Jun. 19, 2018, now Pat. No. 10,900,181.

(60) Provisional application No. 62/522,035, filed on Jun. 19, 2017.

(51) Int. Cl.
*E01F 13/12* (2006.01)
*E01F 13/06* (2006.01)

(52) U.S. Cl.
CPC ..... *E01F 13/12* (2013.01); *E01F 13/06* (2013.01)

(58) Field of Classification Search
CPC ..... E01F 13/02; E01F 13/06; E01F 13/12; E06B 11/025
See application file for complete search history.

(56) References Cited

U.S. PATENT DOCUMENTS 5,466,088 A * 11/1995 Nasatka ..... E01F 13/08 404/6
6,115,963 A * 9/2000 Allardyce ..... B61L 29/04 49/226
6,119,399 A * 9/2000 McCain ..... E01F 13/06 49/340
7,062,879 B2 * 6/2006 Wenzl ..... E01F 13/06 49/49
7,775,738 B2 * 8/2010 Darcy ..... E01F 13/12 404/6
8,182,169 B2 * 5/2012 Thompson ..... E01F 13/123 404/9
8,292,538 B2 * 10/2012 Morgan ..... E01F 13/08 404/11
2003/0159356 A1 * 8/2003 Russell ..... E01F 13/06 49/226
2007/0126598 A1 * 6/2007 Carter ..... E01F 13/06 340/908
2016/0002870 A1 * 1/2016 Younce ..... E01F 13/06 49/13

* cited by examiner

*Primary Examiner* — Gregory J Strimbu
(74) *Attorney, Agent, or Firm* — Shackelford, Bowen, McKinley & Norton, LLP; Henry L Ehrlich

(57) ABSTRACT

A vehicle gate assembly includes a first post and a latch post comprising a J-slot formed along a face of the latch post, the J-slot comprising a primary vertical slot extending from an open top end of the primary vertical slot at a top side of the latch post to a bottom end of the primary vertical slot, a horizontal slot extending from the bottom end toward the first post, and the horizontal slot comprising a trap extending toward the top side of the latch post and a beam movable between an open position to allow vehicles to drive through a vehicle passage and a closed position blocking the vehicle passage, and a pin extending from the beam, the pin disposed in the J-slot when the beam is in the closed position.

15 Claims, 18 Drawing Sheets

VEHICLE GATE ASSEMBLY

BACKGROUND

This section provides background information to facilitate a better understanding of the various aspects of the disclosure. It should be understood that the statements in this section of this document are to be read in this light, and not as admissions of prior art.

Vehicle barrier systems are used to stop motor vehicles trying to forcibly gain access to a compound or facility. Anti-ram vehicle barriers (AVB) systems or vehicle security barriers (VSB) are configured to stop motor vehicles, such as trucks, that are intentionally crashed into the barrier in an attempt to breach the barrier. Passive barriers (e.g., fences, walls) are static after installation and deployment, in other words, passive barriers "never" allow vehicular access to certain areas, while active barriers (e.g., gates, drop arms, active wedges) control or limit vehicular access to a particular area.

Some anti-ram vehicle barriers are crash tested to ensure compliance with and obtain certification from a recognized standard. For example, the American Standard Test Method (ASTM F2656 Standard Test Method for Vehicle Crash Testing of Perimeter Barriers), British Standard Institute (PAS 68) and the International Organization for Standardization (ISO) and International Works Agreement (IWA 14-1).

The U.S. State Department (DOS) published the certification standard SD-STD-02.01 (Test Method for Vehicle Crash Testing of Perimeter Barriers and Gates) in 1985. The test vehicle was specified as a medium-duty truck weighing 15,000 lb (6800 kg) and the nominal velocities were 30 mph (50 km/hr), 40 mph (65 km/hr) and 50 mph (80 km/hr). Penetration was measured from the pre-impact attack (front) side of the vehicle security barrier (VSB) and classified into three categories of penetration rating. In 2003, the standard was revised with measuring the penetration from the asset or protected (rear) side of the barrier and the limitation of permissible vehicle penetration to one meter (the highest level of penetration rating).

In 2007, the SD-STD-02.01 was replaced with ASTM F2656-07. This new standard included the medium-duty truck and added three new test vehicle types, a small passenger car, pickup truck, and heavy good truck. ASTM F2656-07 maintained three predetermined impact velocities for each vehicle category and the penetration is measured from the rear face of the barrier and classified into four categories of penetration rating. ASTM F2656 was revised in 2015 (ASTM F2656-15) to include two additional vehicle types, a full-sized sedan and a cab over/cab forward class 7 truck and it excluded the lowest penetration rating (P4).

The vehicle rating is designated with a prefix indicating the test vehicle weight: "M" prefix designates a medium duty vehicle with a gross weight of 15,000 pounds (6,810 kg), "C" prefix designates a car having a vehicle weight of 2,430 pounds (1,100 kg), "PU" prefix designates a pickup having a vehicle weight of 5,070 pounds (2,300 kg), and "H" prefix designates a heavy goods vehicle having a vehicle weight of 65,000 pounds (29,500 kg). The penetration ratings include P1 for less than or equal to 1 meter (3.3 ft); P2 for 1.10 to 7 m (3.31 to 23.0 ft); P3 for 7.01 to 30 m (23.1 to 98.4 ft); and, prior to 2015, P4 for 30 m (98 ft) or greater.

An ASTM F2656 crash tested vehicle barrier is rated based on the test vehicles weight (e.g., M, C, PU, H), the speed (miles per hour) of impact (e.g., 30, 40, 50, 60), and the penetration (P1, P2, P3, and P4) of the vehicle. For example, an M50-P1 crash barrier is designed to stop a medium duty truck traveling 50 mph with a penetration distance of 3.3 feet or less.

In 2005, the British Standard Institute (BSI) published PAS 68:2005 Specification for Vehicle Barriers: Fixed Bollards. The standard was expanded within two years to include other types of barriers, such as gates and road blockers. The 2013 version, "Impact Test Specifications for Vehicle Security Barrier Systems," rates vehicle barrier systems based on six types of test vehicles, including seven test speeds, and penetration is measured from the rear (protected side) face of the barrier. PAS 68 defines the vehicle type, penetration, dispersion of debris and records the angle of the vehicle's approach. The PAS 68 rating includes a 5-to-7-part classification code, the includes: Classification of Test/Gross Weight of Vehicle (kg) (Vehicle Class)/Impact Speed/Angle of Impact: Distance Leading Edge of Load Bay travels beyond the Original Position of Rear Face/Dispersion Distance of major debris weighing 25 kg or more from the barrier to establish standoff distance. For example, a barrier (bollard) tested by impact by a 7500 kg day cab ("V") at a ninety-degree angle traveling 80 km/hr and resulting in penetration of 7.5 m with significant debris scattered up to 20.0 m away would be designated as V/7500 (N3)/80/90:7.5/20.0. The dispersion distance may be utilized to determine a standoff distance for example to mitigate damage from a vehicle born improvised explosive device (VBIED)

The European Committee for Standardization (CEN) recognized across 34 European countries has produced a standard CWA 16221 that combines details of BS PAS 68 and PAS 69. PAS 69 provides guidance on the barrier's use and installation.

In 2013, the International Works Agreement (IWA) 14-1: 2013 was published to provide an international specification for crash testing. The system was developed by government agencies, military bodies and providing companies from the USA, UK, Germany, Norway, Oman, Singapore, and Syria. This standard includes a merging of the British PAS 68 and the American ASTM F2656 vehicle impact test specifications. This international standard assesses vehicle barrier performance based on nine types of test vehicles with up to seven test speeds. Penetration is measured from the front (attack side) face of the vehicle safety barrier. The IWA 14-1 classification code represents Vehicle Impact Test/Gross Weight of Vehicle (Vehicle Class)/Impact Speed/Angle of Impact/Penetration beyond the original position of the front/impact face.

Entry through vehicle access points is often controlled by gates, such as drop arm gates, however, such access gates are not typically anti-ram crash-rated barriers. At secure locations, the vehicle gates are commonly permanent installations, which facilitate erecting a gate assembly that is secured in a below-grade foundation that can absorb the energy of an impacting vehicle and arrest the forward progress of the vehicle. Commonly, anti-ram type barriers are constructed as massive obstructions to function, by their own mass and/or positioning in the ground, as an immovable mass to stop an impacting vehicle.

SUMMARY

An exemplary vehicle gate assembly includes a base having a width extending laterally to define a vehicle passage and having a depth extending perpendicular to the width from a front edge of the base to a back edge of the base, a first post extending vertically from the base on a first lateral side of the vehicle passage, a latch post comprising a J-slot formed along a face of the latch post, the J-slot comprising a primary vertical slot extending from an open top end of the primary vertical slot at a top side of the latch post to a bottom end of the primary vertical slot, a horizontal slot extending from the bottom end toward the first post, and the horizontal slot comprising a trap extending toward the top side of the latch post, a beam having a first beam end connected to the first post and a second beam end, the beam movable between an open position to allow vehicles to drive through the vehicle passage and a closed position blocking the vehicle passage, and a pin extending from the second beam end, the pin disposed in the J-slot when the beam is in the closed position. In accordance with some embodiments, the vehicle gate assembly is configured to achieve a crash rating in accordance with ASTM F2656. Embodiments of the disclosed gate assembly are configured to be crash-rated by certifying agencies such as DOD, DOS, ASTM, and British Standards (BSI).

An exemplary vehicle gate assembly includes a base having a width extending laterally to provide a vehicle passage over the base and a depth extending perpendicular to the width from a front edge to a back edge, the base is configured to be positioned on top of a ground surface; a hinge post extending vertically from the base on a first lateral side of the vehicle passage; a latch post assembly extending vertically from the base on a second lateral side of the vehicle passage, the latch post assembly including first and second latch posts each having an inner face, the first and second latch posts spaced apart to form a latch post gap between the inner faces extending parallel with the width; and a barrier beam having a first end pivotally connected to the hinge post and a second end; the barrier beam is movable between an open position to allow vehicles to drive over the base through the vehicle passage and a closed position blocking the vehicle passage and the second end of the barrier beam is disposed in the latch post gap when the barrier beam is in the closed position.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
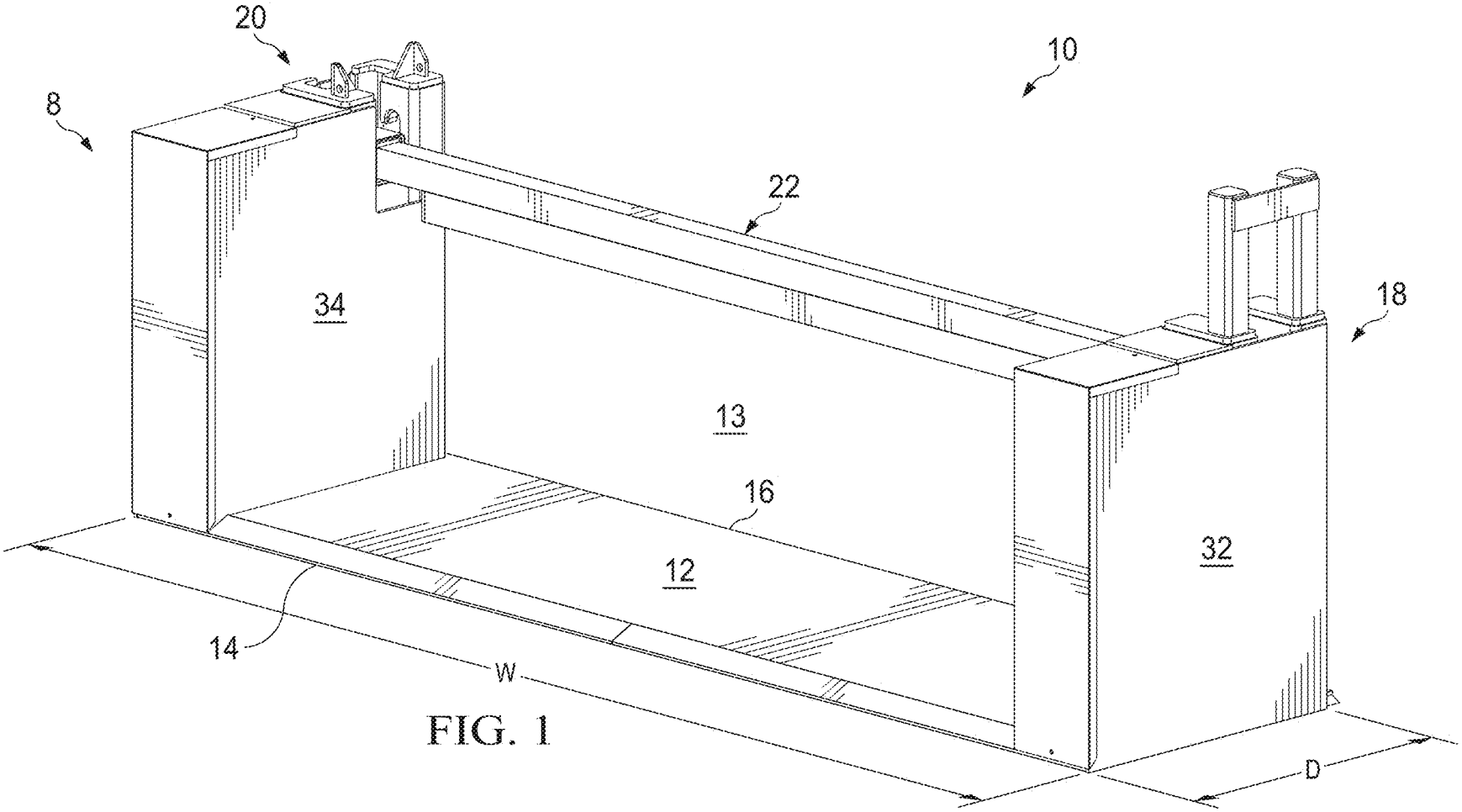
FIG. 1 is a perspective view of an example of a vehicle gate assembly according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and they are not intended to be limiting. For example, a figure may illustrate an exemplary embodiment with multiple features or combinations of features that are not required in one or more other embodiments and thus a figure may disclose one or more embodiments that have fewer features or different combination of features than the illustrative embodiment. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not in itself dictate a relationship between the various embodiments and/or configurations discussed.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features. Further, the figures may illustrate exemplary embodiments that show features or combination of features that are not required in one or more embodiments and thus a specific figure may disclose one or more embodiments that have fewer features or different combination of features than those shown in the illustrated embodiment.

As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. Terms such as "up," "down," "top," and "bottom" and other like terms indicating relative positions to a given point or element may be utilized to describe some elements more clearly. Commonly, these terms relate to a reference point such as the ground level.

Portable gate assemblies are disclosed herein for positioning at vehicle access crossings into a protected area. The protected area may be a temporary or permanent area into which entry is limited, at least limited to motor vehicles through the one or more vehicle access locations. Non-limiting examples of protected areas include parking garages and surface parking areas, grounds for sporting events and celebrations, and high-security locations such as government, military and business installations and power generating and distribution installations.

Portable gate assemblies can be transported as a unit for example on a light or medium-duty truck and positioned at the vehicle access location to the protected area. Portable gate assemblies include assemblies that can be placed on a ground surface and utilized without being physically secured below the ground surface. Portable gate assemblies can also be secured on top of the ground surface and utilized as what is also known as a surface mounted gate, for example, a base (e.g., tread plate) may be placed on the ground surface and secured in place with fasteners. As will be understood by those skilled in the art with the benefit of the disclosure, aspects of the example portable gate assemblies can be utilized in active barrier systems that are erected on-site and secured in the ground foundation or a semi-permanent fixture associated with the ground foundation.

In accordance with embodiments of the disclosure, the portable gate assemblies are configured to provide a requisite stopping capability in the event that a motor vehicle, such as a 15,000 pounds (6.8 metric tons) medium-duty truck, crashes into the portable gate. In accordance with embodiments of the disclosure, a requisite stopping capability will be in accordance with standards established for example by ASTM F-2656, which identifies impact conditions including the vehicle weight, impact velocity, and penetration distance. With reference to a medium-duty truck, having a weight of about 15,000 lb (6,800 kg), the speed ratings include M30 for traveling at 28.0 to 37.9 miles per hour (mph), M40 traveling at 38.0 to 46.9 mph, and M50 traveling at 47.0 mph and above. The penetration ratings include P1 for less than or equal to 1 meter (3.3 ft); P2 for 1.10 to 7 m (3.31 to 23.0 ft); and P3 for 7.01 to 30 m (23.1 to 98.4 ft). For example, an ASTM F2656 crash-rated M50-P1 barrier is designed to stop a medium duty truck traveling 50 mph with a penetration distance of 3.3 feet or less.

In accordance with at least one embodiment, the portable gate assembly is configured to achieve an M30 speed rating with a P1 penetration rating. In accordance with at least one embodiment, the portable gate assembly is configured to achieve an M30 speed rating with a P2 penetration rating. In accordance with at least one embodiment, the portable gate assembly is configured to achieve a M30 speed rating with a P3 penetration rating.

In accordance with at least one embodiment, the portable gate assembly is configured to achieve an M40 speed rating with a P1 penetration rating. In accordance with at least one embodiment, the portable gate assembly is configured to achieve an M40 speed rating with a P2 penetration rating. In accordance with at least one embodiment, the portable gate assembly is configured to achieve an M40 speed rating with a P3 penetration rating.

In accordance with at least one embodiment, the portable gate assembly is configured to achieve an M50 speed rating with a P1 penetration rating. In accordance with at least one embodiment, the portable gate assembly is configured to achieve an M50 speed rating with a P2 penetration rating. In accordance with at least one embodiment, the portable gate assembly is configured to achieve an M50 speed rating with a P3 penetration rating.

Some embodiments may be configured to achieve similar speed and penetration ratings for impact vehicles such as cars having a weight up to about 2,430 lb (1,100 kg) (e.g., C40, C50, C60) and heavy goods vehicles having a weight of about 65,000 lbs (29,500 kg) (e.g., H30, H40, H50).

FIG. 1 illustrates an example of a portable gate assembly 10 that is configured to achieve an ASTM-F2656 crash rating. The illustrated portable gate assembly 10 is described as a portable gate that is installed by placing on the surface of the ground (i.e., foundation) in a location to limit the entrance of motor vehicles into a protected area. In accordance with some embodiments, the portable gate assembly 10 is not secured to the ground surface. In accordance with some embodiment, the portable gate assembly 10 may be a surface-mounted gate that is secured to the surface of the ground foundation. In the illustrated figures, the portable gate assembly includes a movable barrier in the form of an arm (e.g., drop arm) that carries, for example, a cable or rope, however, it will be recognized that the arm may take other configurations. For example, and without limitation, the illustrated linear arm may be replaced with a U-shaped member to reduce the vertical clearance required to fully raise the barrier and allow a vehicle to pass. Installations such as parking garages may present vertical clearance limitations.

Figure 3:
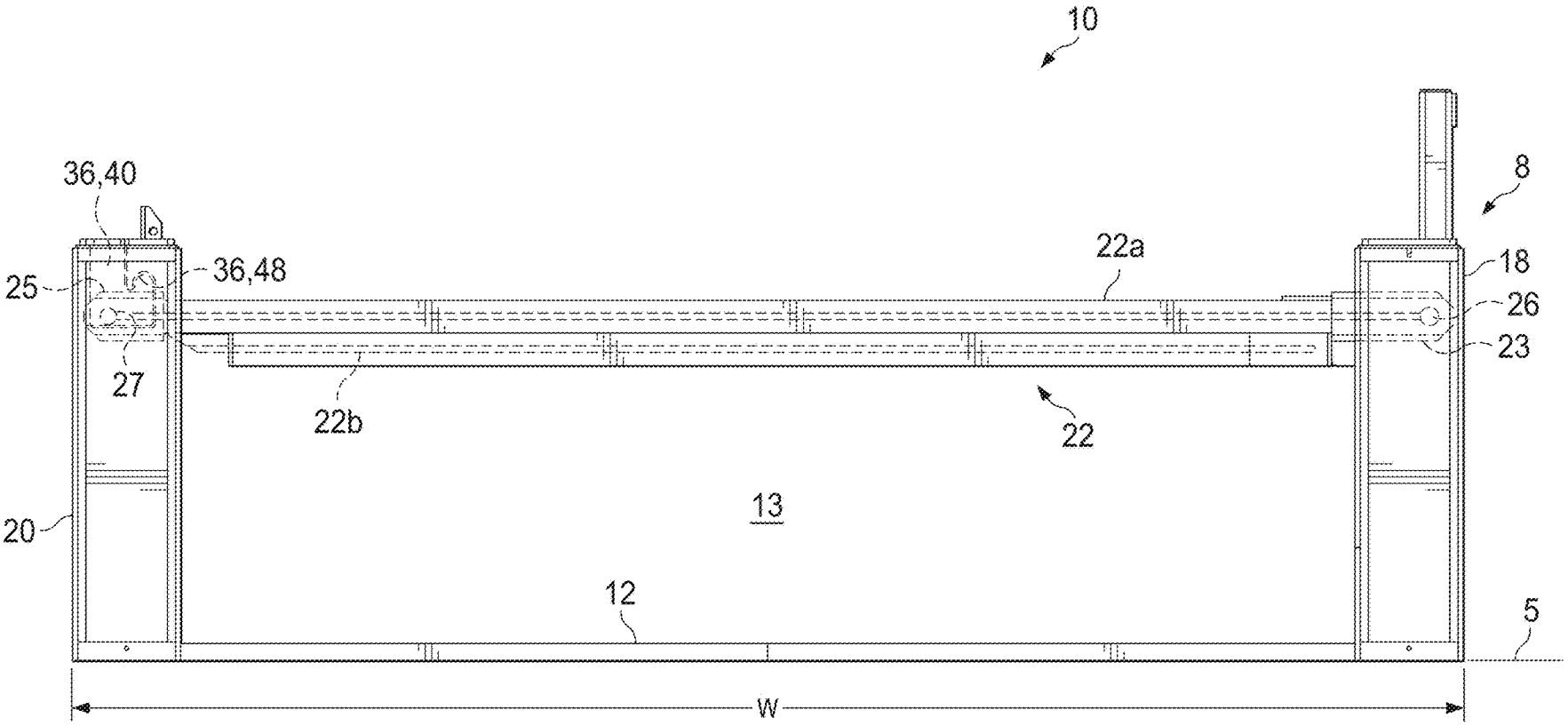
FIG. 3 is a front elevation view from the attack side of an exemplary vehicle gate assembly according to one or more aspects of the disclosure.
Figure 4:
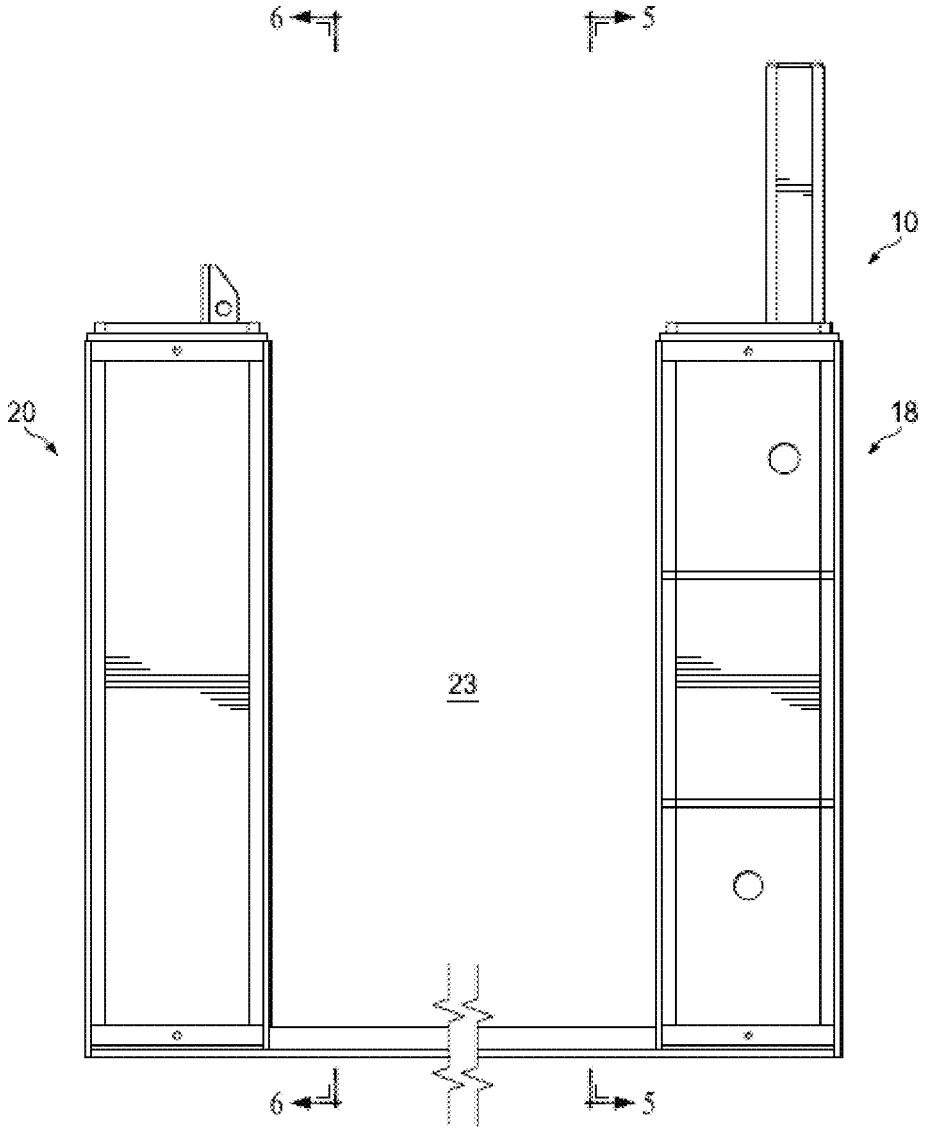
FIG. 4 is a front elevation view from the attack side of an exemplary vehicle gate assembly with the barrier removed according to one or more aspects of the disclosure.
Figure 5:
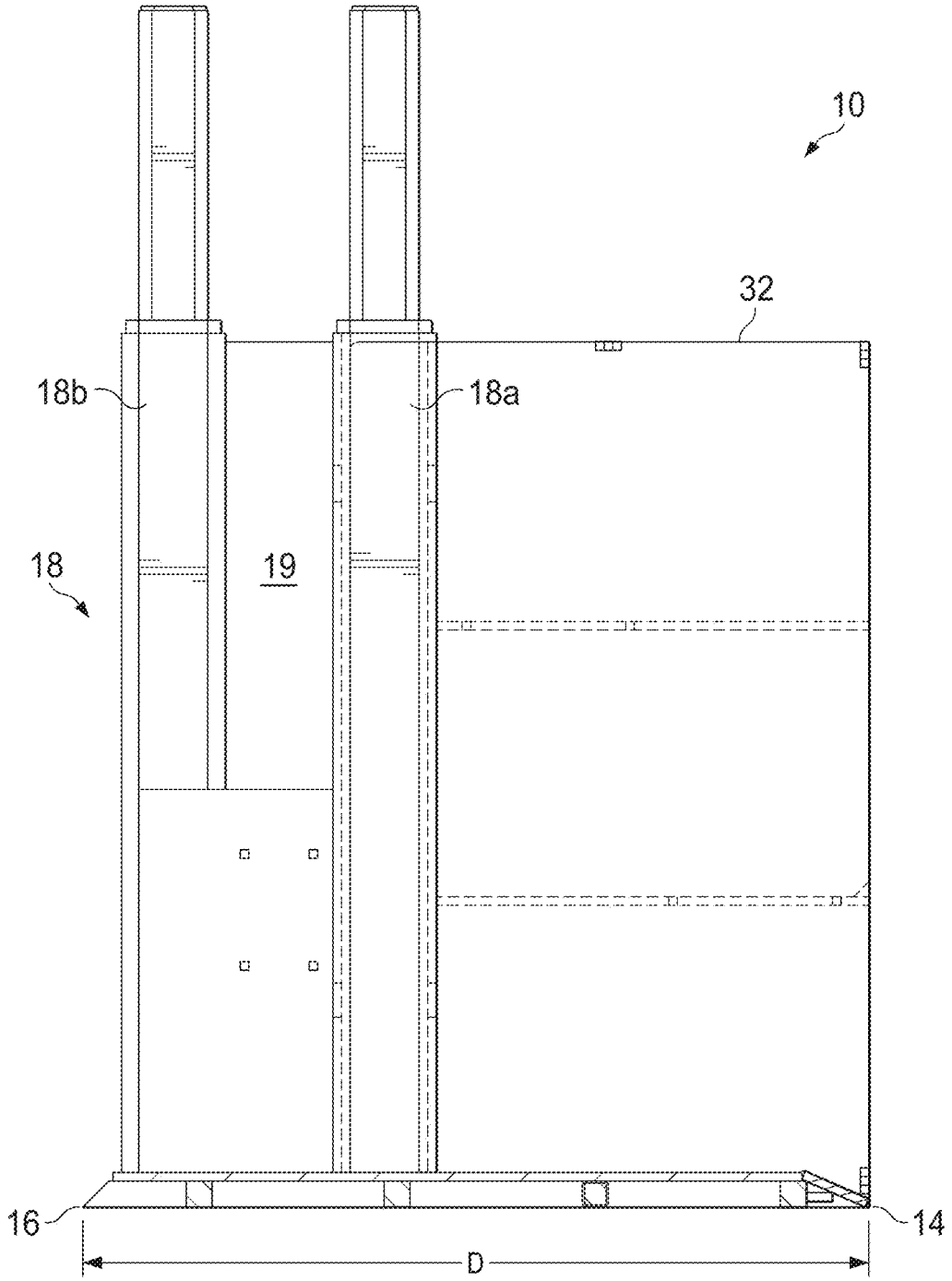
FIG. 5 is a view of the hinge post assembly along the line 5-5 of FIG. 4.
Figure 6:
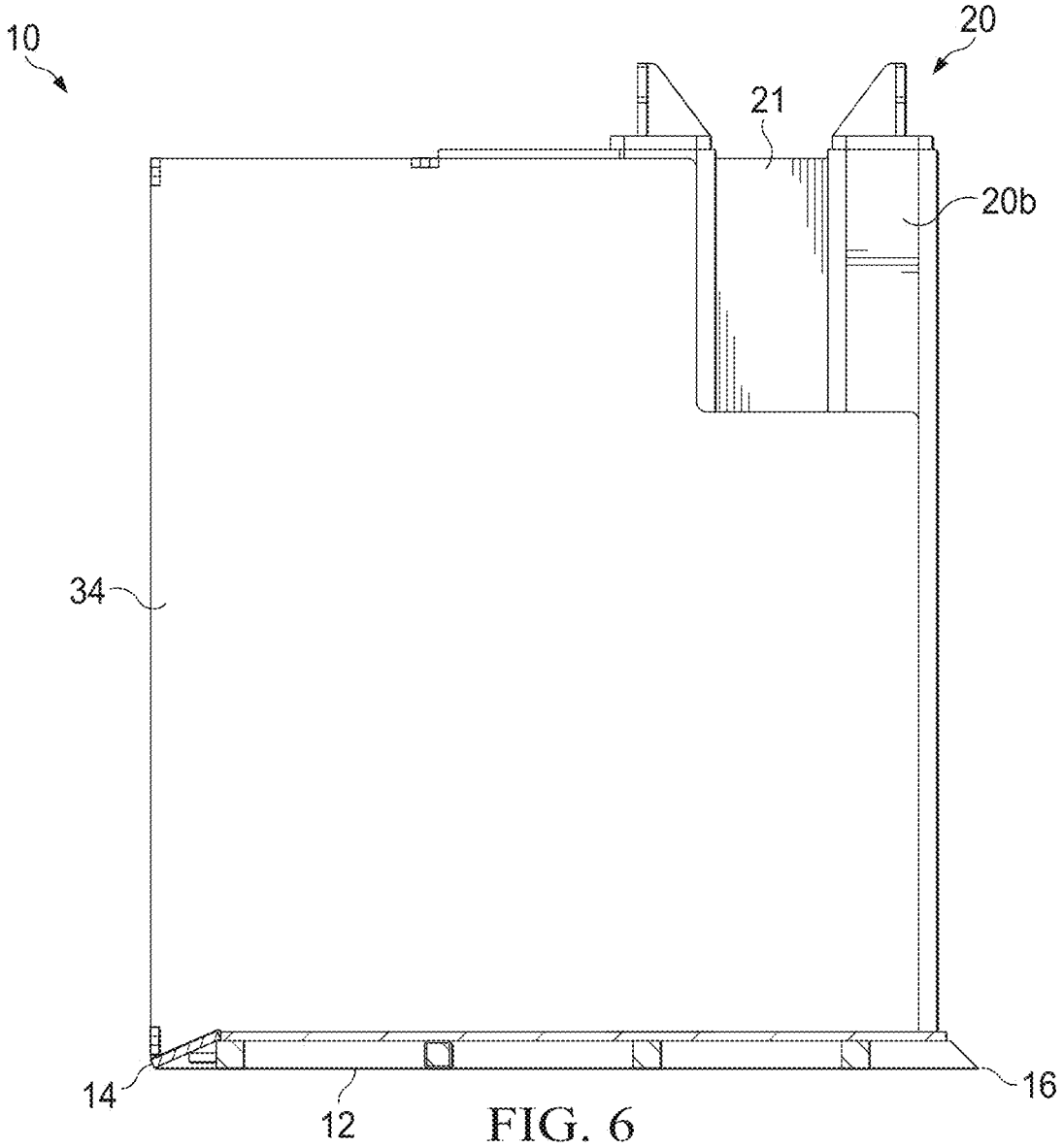
FIG. 6 is a view of the latch post assembly along the line 6-6 of FIG. 4.
Figure 7:
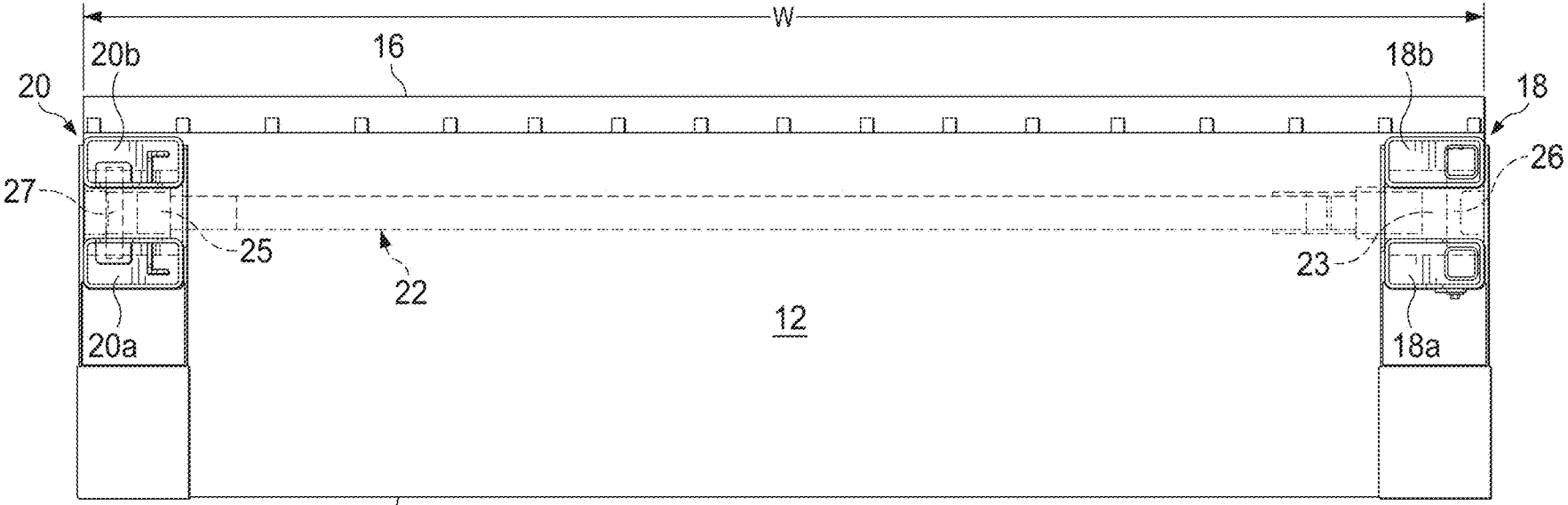
FIG. 7 is a plan view of an exemplary vehicle gate assembly according to one or more aspects of the disclosure.
Figure 8:
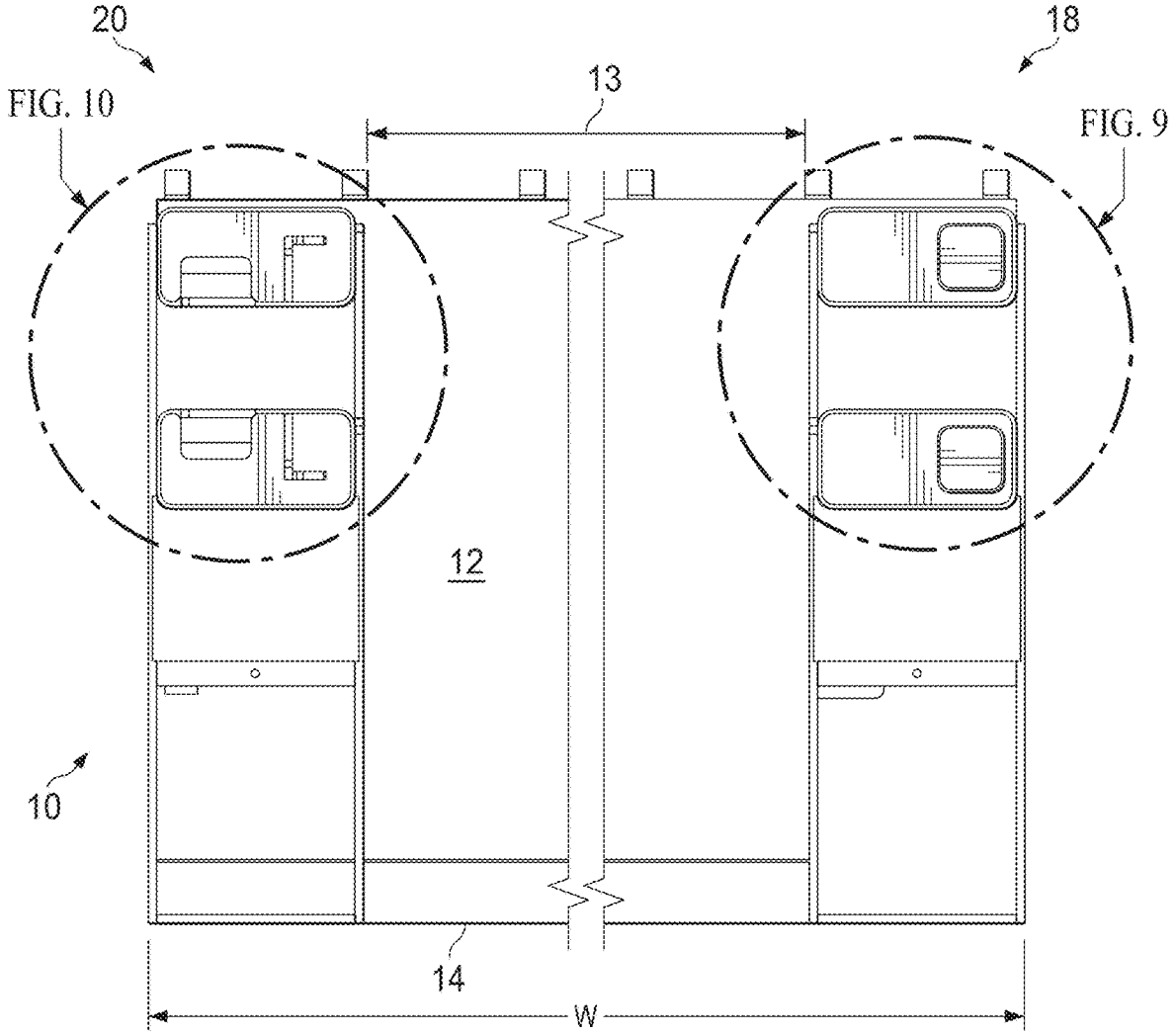
FIG. 8 is a plan view of an exemplary vehicle gate assembly with the barrier removed according to one or more aspects of the disclosure.
Figure 10:
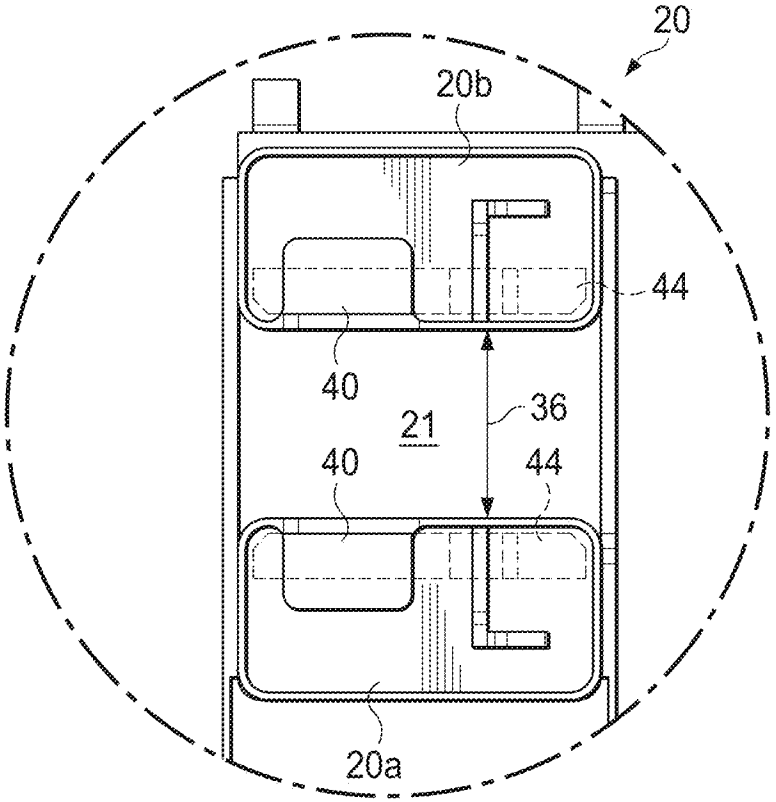
FIG. 10 is a plan view of the latch post assembly at detail "FIG. 10" of FIG. 8.
Figure 9:
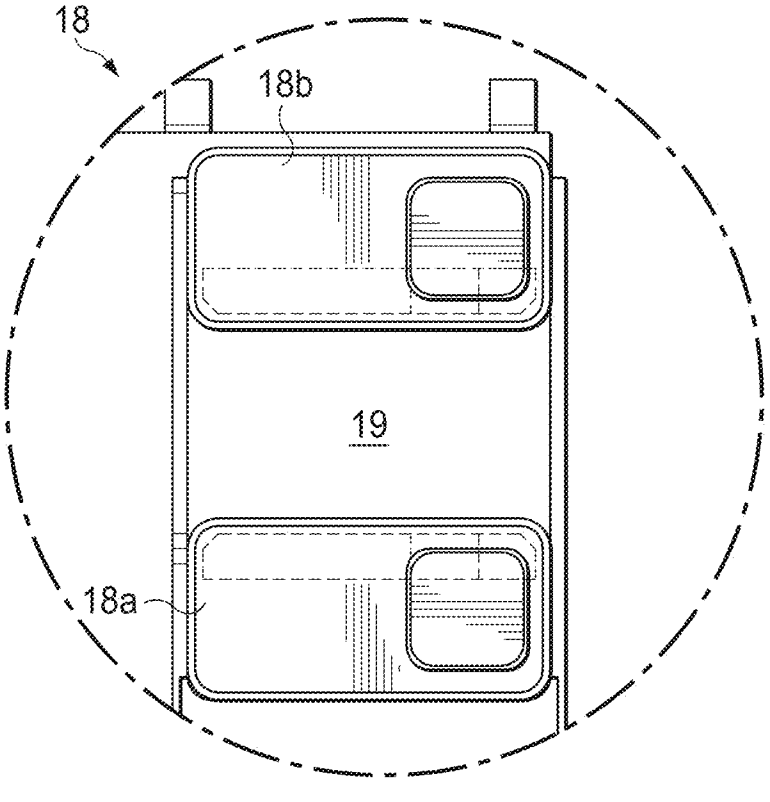
FIG. 9 is a plan view of the hinge post assembly at detail "FIG. 9" of FIG. 8.
Figure 22:
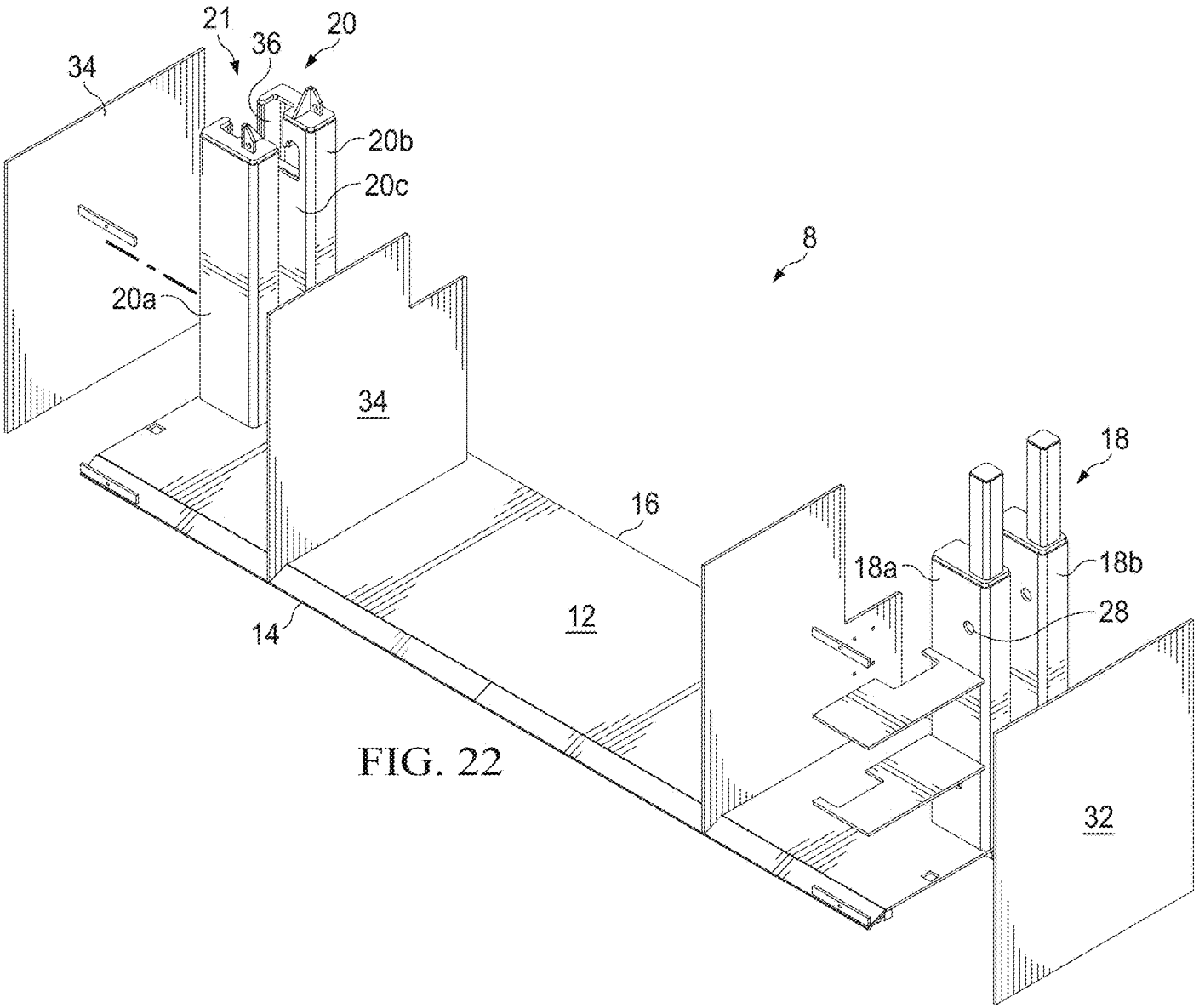
FIG. 22 is an exploded isometric view of an exemplary frame of a gate assembly according to one or more aspects of the disclosure.
Figure 23:
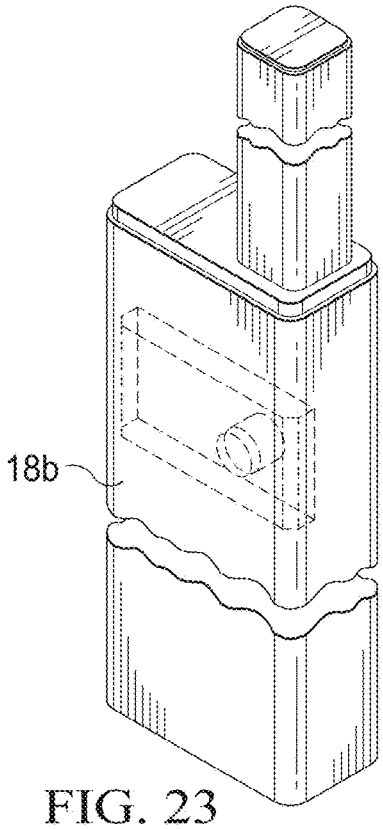
FIG. 23 illustrates an exemplary protected side hinge post of a hinge post assembly according to one or more aspects of the disclosure.
Figure 24:
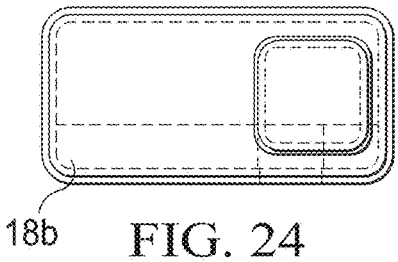
FIG. 24 is a top view of the exemplary protected side hinge post of FIG. 23.

Referring in particular to FIGS. 1, 3, and 22, a portable or surface-mounted active gate assembly 10 includes a frame 8 and a movable barrier 22. The frame 8 includes a base 12 having a longitudinal or lateral width "W" extending perpendicular to the direction of traffic flow to form a vehicle passage 13 and an axial depth "D" extending parallel to the traffic flow. The base 12 includes a laterally extending attack-side or threat-side edge 14 and a laterally extending protected-side edge 16. The threat- or attack-side edge 14 is the front edge of the base facing vehicles traveling in the direction toward the protected area and the protected-side edge 16 is on the opposite side of base 12.

Figure 29:
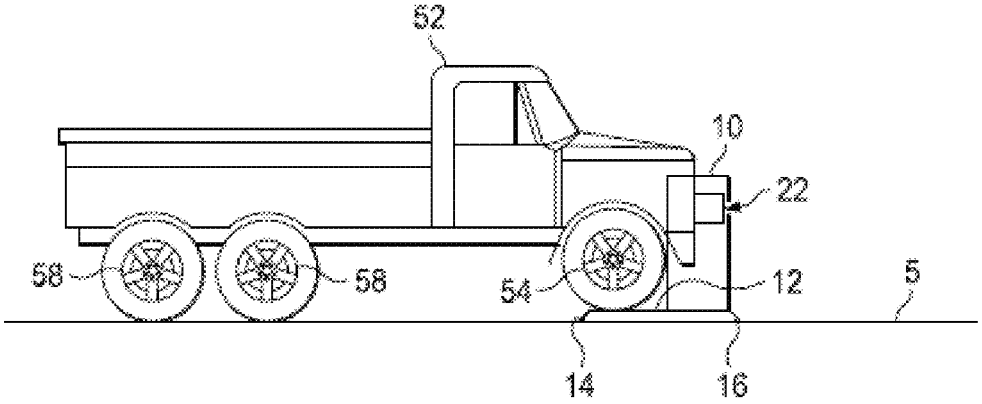
FIG. 29 illustrates an exemplary gate assembly according to one or more aspects of the disclosure relative to a motor vehicle approaching from an attack side.

The base 12 is placed on top of the ground level 5 (FIG. 3) and includes, for example, a metal tread plate across which a motor vehicle can drive. In the illustrated example, the metal tread plate extends for example to a height of about 2 inches above ground level. Gate assembly 10 includes a hinge post assembly 18 and a latch post assembly 20 located at opposite lateral ends of the base 12 to form the vehicle passage 13 therebetween. In some of the illustrated embodiments, the width of the vehicle passage 13 is about 12 feet. Gate assembly 10 includes a moveable barrier 22 pivotally connected at a first end 23 to the hinge post assembly 18 and in the closed position, the second end 25 is positioned within a portion of the latch post assembly 20. The moveable barrier 22 is located adjacent to and above the protected-side edge 16 of the base 12 on the opposite side of the base from the attack-side edge 14. When a vehicle 52 impacts the barrier 22, the front wheels 54 will be located on the base 12 as shown for example in FIGS. 29 and 30. If a vehicle approaches the gate assembly 10 slowly in an effort to push the gate assembly 10 as shown in FIG. 29, the front tires will be on the base 12 and the weight of the vehicle 52 will prevent the vehicle 52 from moving the gate assembly 10 out of position even if the base 12 is not fastened to the ground surface.

Portable gate assembly 10 can be transported and delivered to the vehicle access location for example on the back of a flat-bed vehicle or in a trailer that may be towed behind a vehicle such as a car, pickup, light- or medium duty truck. The portable gate assembly 10 can be offloaded and positioned on top of the ground surface at the vehicle access location. The portable gate assembly 10 may be operable immediately or within minutes of placement on the ground surface. For an automated or otherwise mechanically actuated barrier arm embodiment, the portable gate assembly 10 may be operational upon connecting a power source. In some embodiments, the portable gate may include a power source. In some embodiments, the barrier arm may be manually hand-operated between the open and closed positions.

Figure 11:
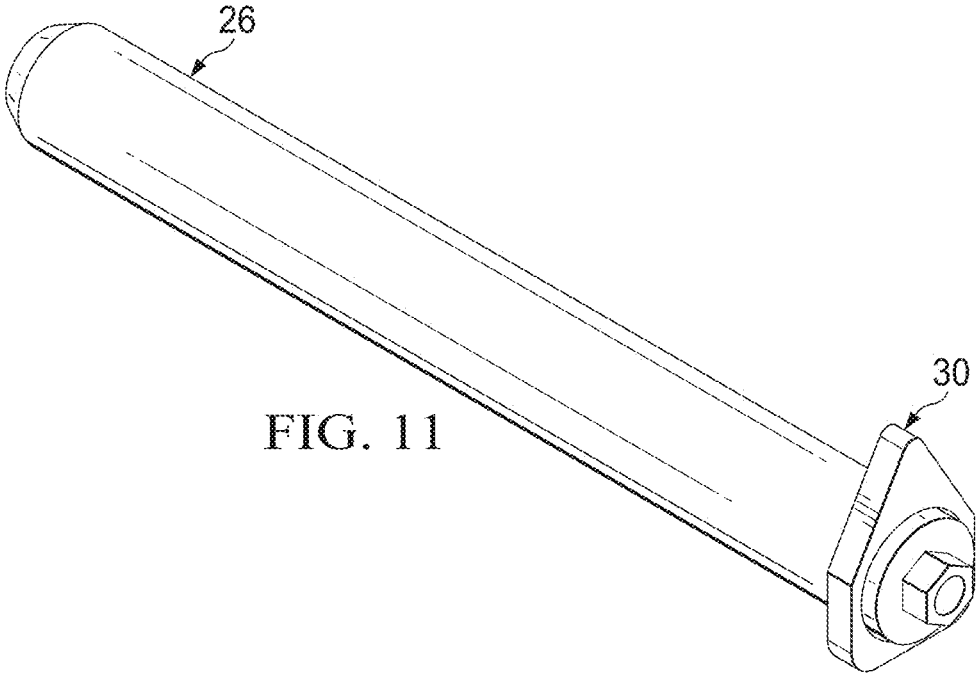
FIG. 11 illustrates a perspective view of an exemplary hinge pin in accordance with one or more aspects of the disclosure.
Figure 12:
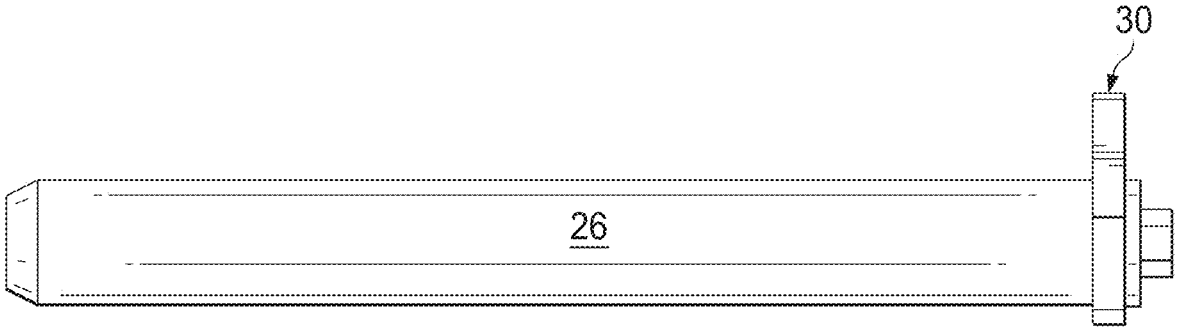
FIG. 12 is a side view of an exemplary hinge pin.
Figure 13:
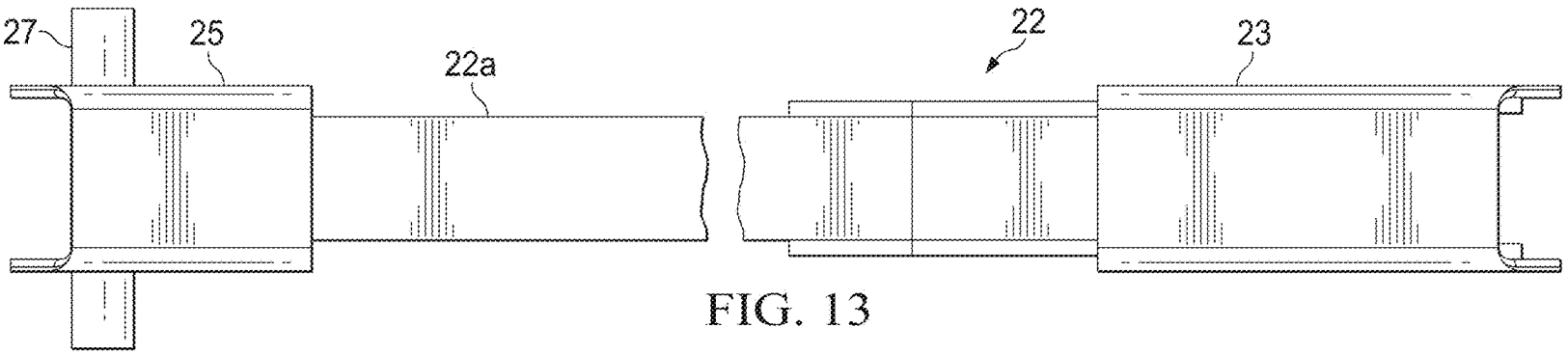
FIG. 13 is a top view of an exemplary barrier beam according to one or more aspects of the disclosure.
Figure 14:
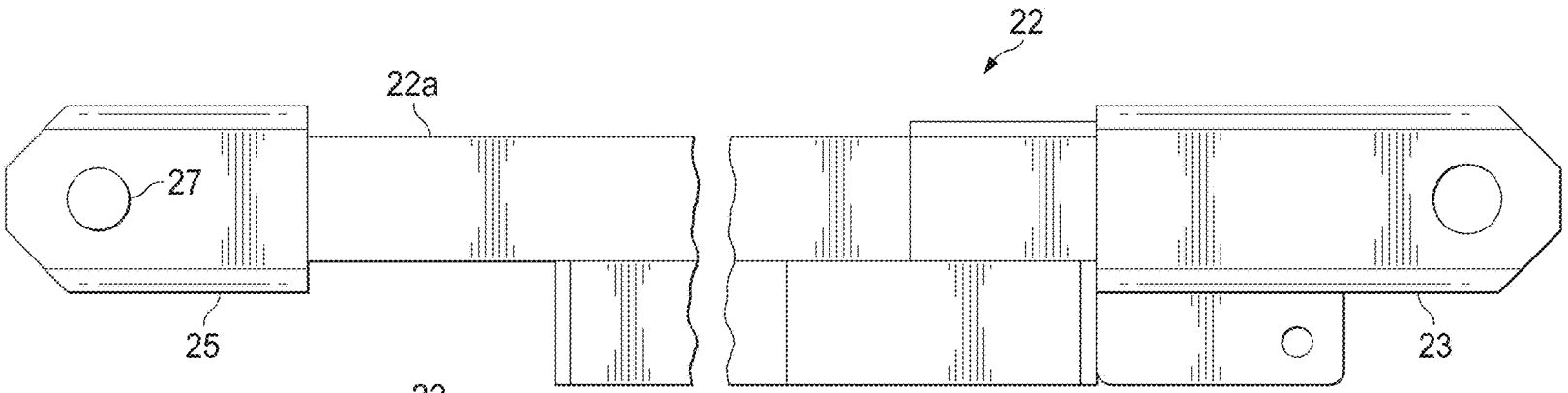
FIG. 14 is a side view of an exemplary barrier extending from a hinge end to a pivot end.
Figure 15:
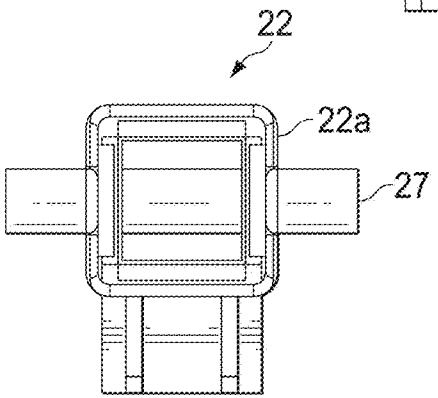
FIG. 15 is an end view of an exemplary barrier member.
Figure 16:
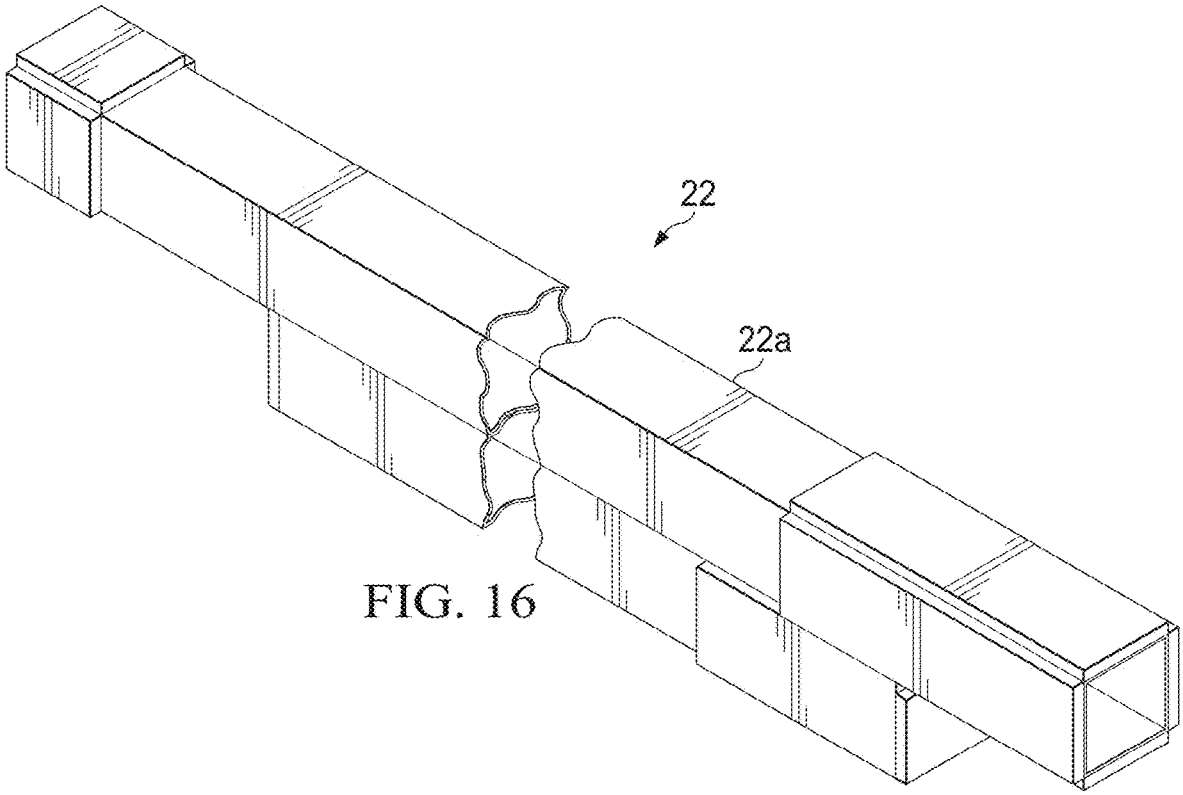
FIG. 16 is a perspective view of a portion of an exemplary barrier member.
Figure 17:
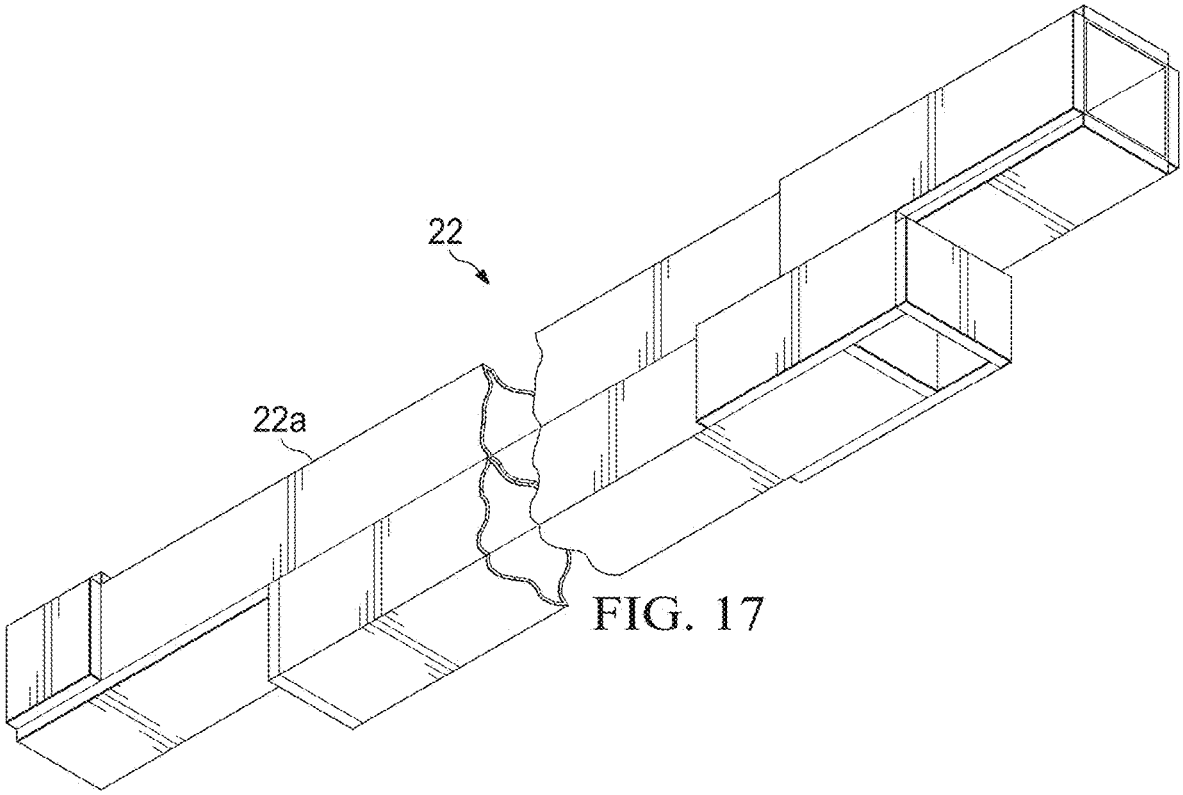
FIG. 17 is another perspective view of a portion of an exemplary barrier member.
Figure 18:
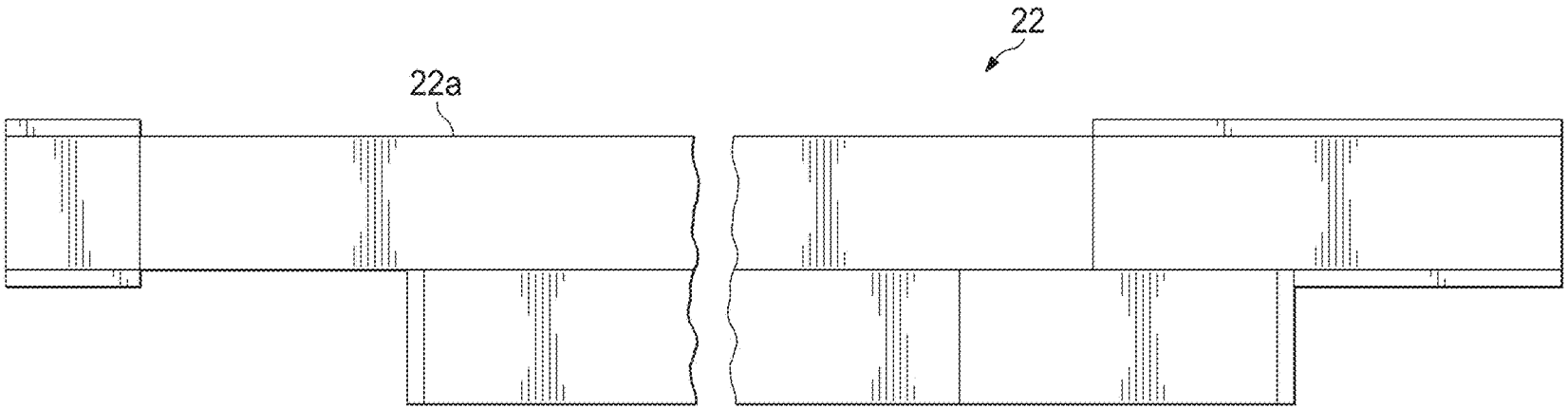
FIG. 18 is a side view of a portion of an exemplary barrier member.
Figure 19:
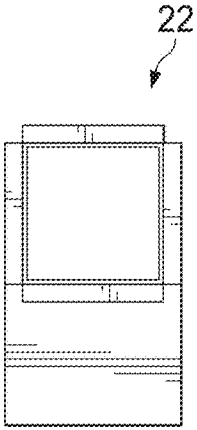
FIG. 19 is an end view of a portion of the exemplary barrier member illustrated in FIG. 18.
Figure 20:
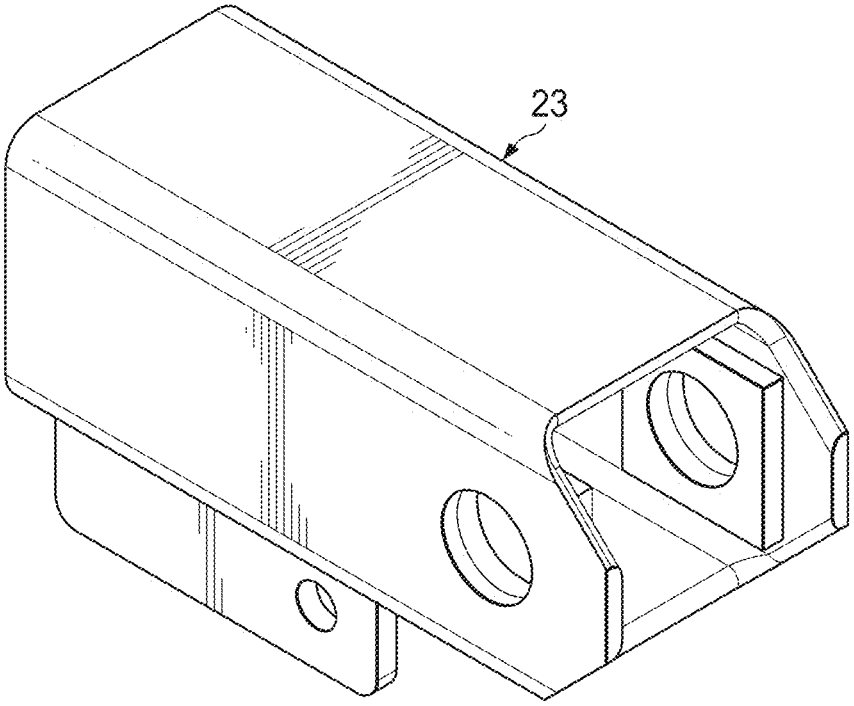
FIG. 20 is an isometric view of an exemplary hinge end of barrier beam according to one or more aspects of the disclosure.
Figure 21:
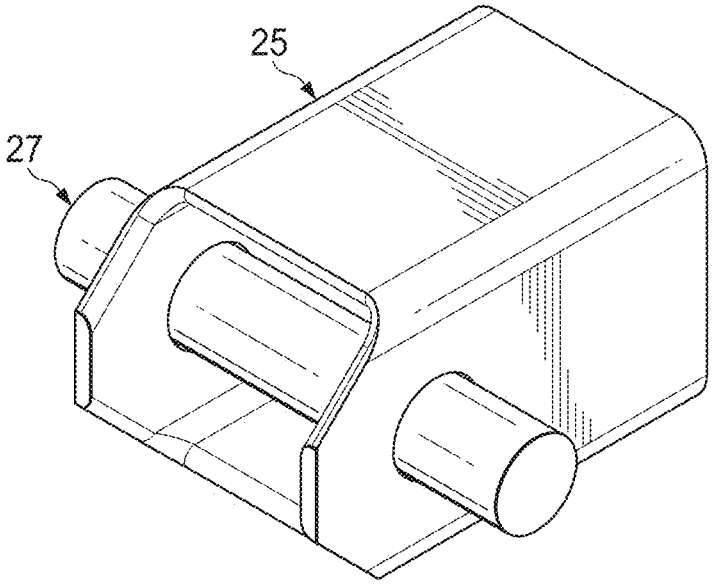
FIG. 21 an isometric view of an exemplary latch end of barrier beam with a latch pin according to one or more aspects of the disclosure.

Referring in particular to FIGS. 3 and 13-21, the illustrated barrier 22 is constructed of or includes a metal beam, identified specifically with reference number 22*a*, extending from a first end 23 (hinge end) to a second end 25 (latch end). The barrier 22 may also include a cable (rope or metal) identified specifically with the reference number 22*b*. The hinge end 23 includes a hinge (pivot) pin 26 (FIGS. 11, 12) that connects the barrier 22 to the hinge post assembly 18. The latch end 25 of the barrier 22, in accordance with some embodiments, includes a latch pin 27 that extends in the axial direction parallel to the flow of traffic and perpendicular to the longitudinal axis of the barrier 22. As will be described below with reference to the latch post assembly, in the normally closed position the latch end 25 and latch pin 27 of the beam 22 are not engaged with the latch post assembly in a manner that hinders or prevents the vertical movement of the barrier 22 relative to the latch post assembly. In the normally closed position, the barrier beam is not being impacted by a vehicle and the latch end and latch pin are disposed in the latch post gap between the opposing latch posts of the latch post assembly. When a vehicle impacts the barrier 22 with sufficient force, as illustrated for example in FIG. 30, the latch end 25 and latch pin 27 will be drawn laterally inward in the direction toward the hinge end 23 and the hinge post assembly 18 and cause the latch pin 27 and the latch end 25 to engage with the latch post assembly 20 in a manner that prevents or limits the movement of the latch end 25 vertically (in the direction away from the base 12) and out of engagement with the latch post assembly 20. This engagement between the latch end 25 and the latch post assembly 20 maintains the barrier 22 in connection with the frame 8 (base 12, hinge post assembly 18, and latch post assembly 20) even if the vehicle impact tips the portable gate assembly 10 as illustrated for example in FIG. 30.

Figure 25:
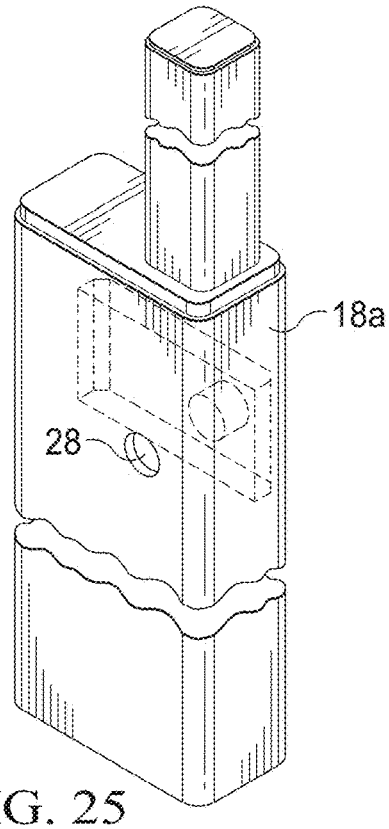
FIG. 25 illustrates an exemplary attack side hinge post of a hinge post assembly according to one or more aspects of the disclosure.
Figure 26:
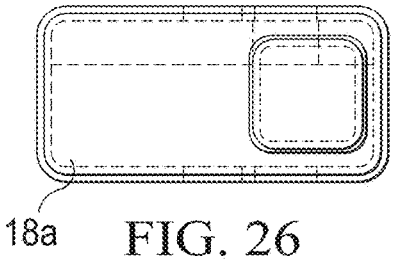
FIG. 26 is a top view of the exemplary attack side hinge post of FIG. 25.
Figure 28:
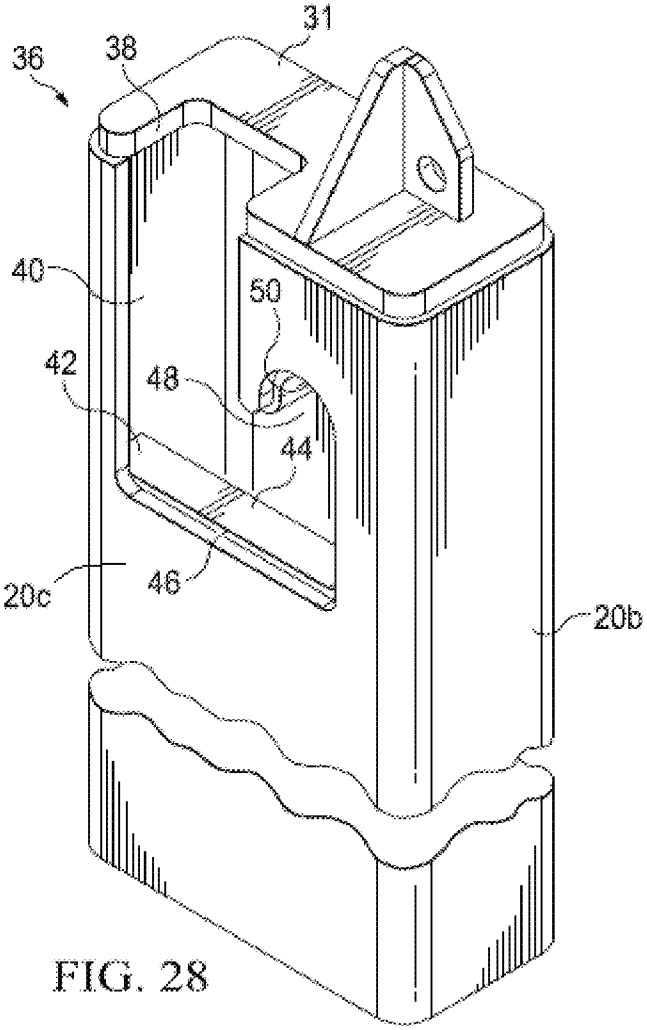
FIG. 28 illustrates an exemplary inside face of a second latch post illustrating an exemplary J-slot.
Figure 27:
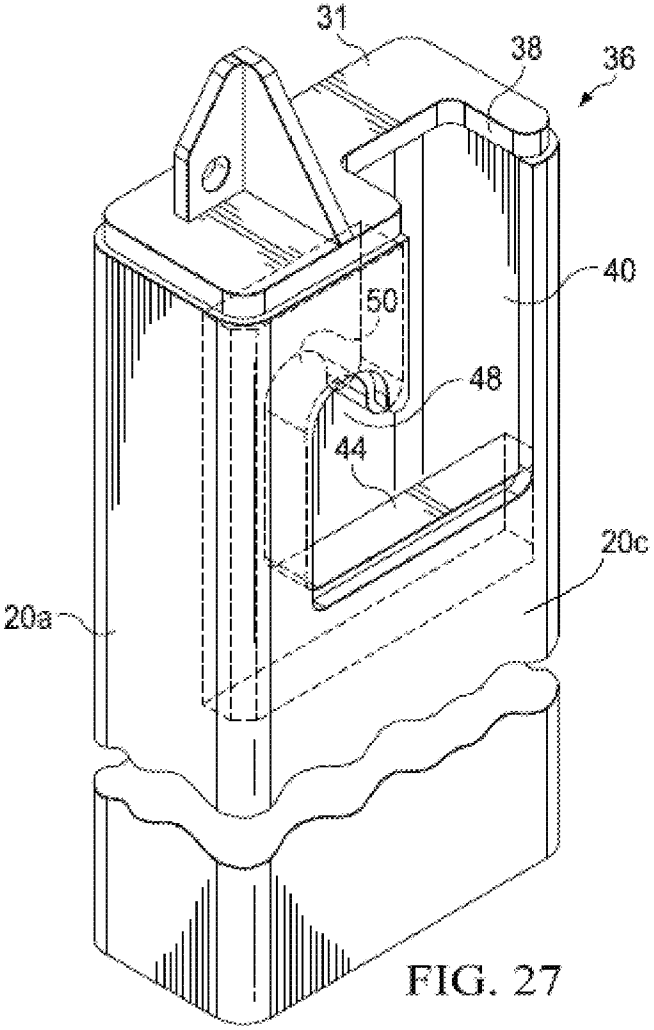
FIG. 27 illustrates an exemplary inside face of a first latch post illustrating an exemplary J-slot according to one or more aspects of the disclosure.

With reference in particular to FIGS. 1-5, 7-9, and 22-26, the illustrated hinge post assembly 18 includes a pair of spaced apart hinge posts 18*a*, 18*b* forming a gap 19 extending parallel to the lateral width of the base 12 and in which the hinge end 23 of the barrier is positioned with the hinge pin 26 connected to both of the hinge posts 18*a*, 18*b*. The attack-side hinge post 18*a* includes a passage 28 (FIG. 25) formed through both sides 17*a* and 17*b* (FIGS. 2, 26) such that a stop 30 (e.g., plate) (FIGS. 11, 12) on a first end of the hinge pin 26 is located on the outer side 17*a* of the first hinge post 18*a* opposite from the gap 19. In the illustrated examples, the hinge post assembly 18 is disposed partially within a housing 32. The hinge post assembly 18 may utilize a single post member.

Figure 2:
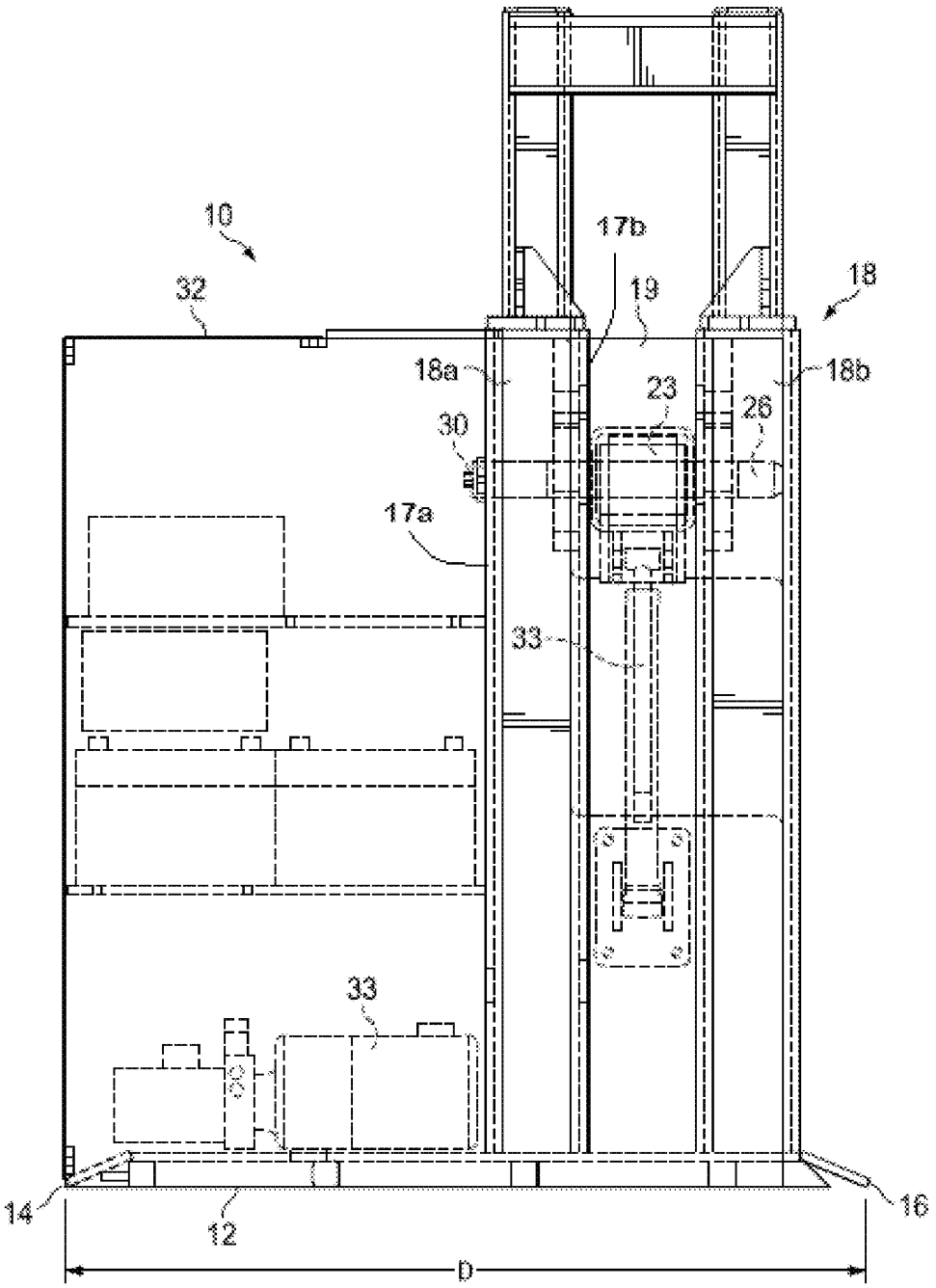
FIG. 2 is a side view from the hinge post side of an exemplary vehicle gate assembly according to one or more aspects of the disclosure.

In FIG. 2, a drive mechanism or actuator 33 is operationally connected with the barrier beam 22 to move the barrier from the closed position as shown FIG. 1 to an open position in which the barrier beam 22 is moved out of the vehicle passage between the hinge and latch post assemblies.

With reference in particular to FIGS. 1, 3, 4, 6, 7, 8, 10, 22, 27, and 28, the illustrated latch post assembly 20 includes a pair of spaced apart latch posts 20*a*, 20*b* forming a gap 21 extending parallel to the lateral width of the base 12 and in which the latch end 25 of the barrier 22 is positioned when in the closed position. The latch post gap 21 is formed between the inner or inside faces 20*c* of the respective latch posts 20*a*, 20*b*. For the purpose of description, the latch post 20*a* is located on the attack-side of the gap 21 with the inner face 20*c* facing away from the attack-side edge 14 and the protected-side latch post 20*b* is positioned adjacent the protected-side edge 16 with its inner face 20*c* facing toward the attack-side edge 14. In accordance with some embodiments, the latch post assembly 20 may include a housing 34 enclosing at least a portion of the latch posts 20*a*, 20*b* and interconnecting the latch posts 20*a*, 20*b* which are also attached directly to the base 12.

Each of the latch posts 20*a*, 20*b* forms a J-slot 36 that is open along the inner face 20*c*. The J-slots on the respective latch posts 20*a*, 20*b* are mirror images across the gap 21. Each J-slot 36 extends from a first top end 38 open at the top side 31 of the latch post 20*a*, 20*b* along a first or primary vertical slot 40 to a first bottom end 42 and extends horizontally along a horizontal slot 44 in the direction toward the hinge post assembly 18 to a second bottom end 46. In an exemplary embodiment, the J-slot 36 further includes a trap or second vertical slot 48 that extends vertically upward, toward top end 31, to a terminal end 50 that is located below the top side 31 and closed to the top side 31.

In operation, when the portable gate assembly 10 is in the normally closed position as illustrated for example in FIG. 29, the latch end 25 of the barrier 22 is disposed in the gap 21 of the latch post assembly 20 and the latch pin 27 is disposed in the primary slot 40. With the latch pin 27 located in the primary slot 40, the barrier 22 cannot be pushed horizontally and moved out of the vehicle passage 13 between the hinge post assembly 18 and latch post assembly 20, but the barrier 22 can be moved vertically out of the vehicle passage 13 to open the gate assembly.

When a motor vehicle impacts the barrier 22 with sufficient force, the barrier 22 will bend and draw the latch end 25 with the latch pin 27 inward toward the hinge post assembly 18. During the impact, the latch pin 27 will travel along the horizontal slot 44. When the latch pin 27 is in the horizontal slot 44, or the trap 48, the barrier 22 is engaged with the latch post assembly 20 and it cannot move vertically or horizontally out of engagement with the latch post assembly 20. The horizontal and vertical directions are defined generally with reference to the base 12 being a bottom, horizontal member of the gate assembly. For example, vertical is substantially perpendicular to the base 12 and horizontal is substantially parallel to base 12.

Figure 30:
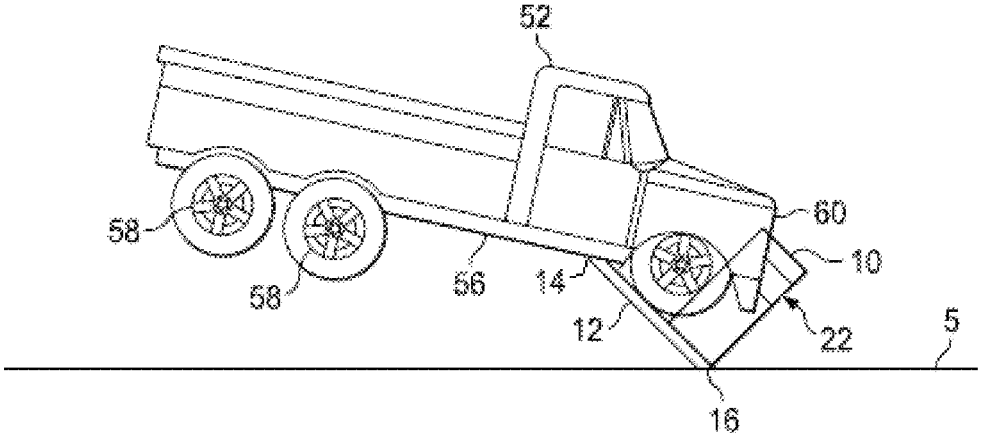
FIG. 30 illustrates an exemplary gate assembly impacted on the attack side by a motor vehicle.

When a vehicle 52 impacts with a sufficient force, the portable gate assembly 10 will tip or pivot about the protected-side edge 16, as illustrated in FIG. 30, and the threat-side edge 14 of base 12 moves upward to engage the frame 56 of the vehicle 52. This tipping or pivoting action uses the kinetic energy of the impacting vehicle 52 to engage the vehicle with the gate assembly 10 and to anchor the gate assembly 10 to the ground surface 5 thereby limiting the penetration of the vehicle. The engagement of the gate assembly 10 with the vehicle 52 tends to interfere with the steering of the vehicle 52 via the front wheels 54 and limits the motorized power of the vehicle by lifting the rear wheels 58 off of the ground surface during the impact. The pivoting action of the portable gate assembly 10 tends to direct the front end 60 of the vehicle downward toward the ground surface 5 as opposed to upward as can occur with many barriers.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A vehicle gate assembly, comprising:

a base having a width and extending laterally to define a vehicle passage and having a depth extending perpendicular to the width from a front edge of the base to a back edge of the base;

a first post extending vertically from the base on a first lateral side of the base;

a latch post extending vertically from the base on a second lateral side of the base and comprising a J-slot formed in a face of the latch post, the J-slot comprising a primary vertical slot extending from an open top end of the primary vertical slot in a top of the latch post to a bottom end of the primary vertical slot, a horizontal slot extending from the bottom end toward the first post, and the horizontal slot comprising a trap extending toward the top of the latch post;

a beam having a first beam end connected to the first post and a second beam end, the beam movable between an open position to allow vehicles to drive through the vehicle passage and a closed position blocking the vehicle passage; and a pin extending from the second beam end, the pin disposed in the J-slot when the beam is in the closed position.

2. The vehicle gate assembly of claim 1, wherein the vehicle gate assembly has at least a P3 rating in accordance with ASTM F2656.

3. The vehicle gate assembly of claim 1, wherein the vehicle gate assembly has a M30-P3 rating in accordance with ASTM F2656.

4. The vehicle gate assembly of claim 1, wherein the pin is disposed in the primary vertical slot when the beam is in the closed position and the pin can move into the horizontal slot when the beam is in the closed position and is impacted with sufficient force to draw the second beam end toward the first post.

5. The vehicle gate assembly of claim 4, wherein the vehicle gate assembly has at least a P3 rating in accordance with ASTM F2656.

6. The vehicle gate assembly of claim 4, wherein the vehicle gate assembly has a M30-P3 rating in accordance with ASTM F2656.

7. The vehicle gate assembly of claim 1, wherein the base is a metal plate.

8. The vehicle gate assembly of claim 1, wherein the beam is positioned vertically above the base proximate the back edge when the beam is in the closed position.

9. The vehicle gate assembly of claim 1, wherein the pin extends orthogonal to a longitudinal axis of the beam.

10. The vehicle gate assembly of claim 1, wherein the beam is positioned vertically above the base proximate the back edge when the beam is in the closed position; and the pin extends orthogonal to a longitudinal axis of the beam.

11. The vehicle gate assembly of claim 10, wherein the vehicle gate assembly has at least a P3 rating in accordance with ASTM F2656.

12. The vehicle gate assembly of claim 10, wherein the vehicle gate assembly has a M30-P3 rating in accordance with ASTM F2656.

13. The vehicle gate assembly of claim 10, wherein the pin is disposed in the primary vertical slot when the beam is in the closed position and the pin can move into the horizontal slot when the beam is in the closed position and is impacted with sufficient force to draw the second beam end toward the first post.

14. The vehicle gate assembly of claim 13, wherein the vehicle gate assembly has at least a P3 rating in accordance with ASTM F2656.

15. The vehicle gate assembly of claim 13, wherein the vehicle gate assembly has a M30-P3 rating in accordance with ASTM F2656.

* * * * *